US006346165B1

(12) United States Patent
Markessini et al.

(10) Patent No.: US 6,346,165 B1
(45) Date of Patent: Feb. 12, 2002

(54) METHOD FOR PRODUCTION OF LIGNOCELLULOSIC COMPOSITE MATERIALS

(75) Inventors: Efthalia Vergopoulou Markessini; Pavlos Mouratidis, both of Thessaloniki (GR); Edmone Roffael, Braunschweig (DE); Luc Rigal, Cedex (FR)

(73) Assignee: Marlit Ltd., Thessaloniki (GR)

( * ) Notice: Subject to any disclaimer, the term of this patent is extended or adjusted under 35 U.S.C. 154(b) by 0 days.

(21) Appl. No.: 09/171,087

(22) PCT Filed: Apr. 10, 1997

(86) PCT No.: PCT/GR97/00012

§ 371 Date: Oct. 13, 1998

§ 102(e) Date: Oct. 13, 1998

(87) PCT Pub. No.: WO97/38833

PCT Pub. Date: Oct. 23, 1997

Related U.S. Application Data

(60) Provisional application No. 60/015,283, filed on Apr. 12, 1996.

(30) Foreign Application Priority Data

Apr. 12, 1996 (GB) ..... 9607566

(51) Int. Cl.[7] ..... B27N 3/02; B27N 3/04; D21C 1/02; D21C 1/04; D21C 1/06

(52) U.S. Cl. ..... 156/296; 264/109; 162/23; 162/26; 162/97; 162/99; 162/225

(58) Field of Search ..... 156/62.2, 296; 264/109; 162/23, 26, 97, 99, 225

(56) References Cited

U.S. PATENT DOCUMENTS

| | | | | |
|---|---|---|---|---|
| 3,627,629 A | * | 12/1971 | Miller | 162/17 |
| 3,843,431 A | | 10/1974 | Dostalik | 156/62.2 |
| 4,022,965 A | * | 5/1977 | Goheen et al. | 536/56 |
| 4,088,528 A | * | 5/1978 | Berger et al. | 162/19 |
| 4,236,959 A | * | 12/1980 | Reinhall | 162/23 |
| 4,420,357 A | * | 12/1983 | Neubauer et al. | 156/274.6 |
| 4,490,517 A | * | 12/1984 | Fuzesi et al. | 527/401 |
| 4,869,783 A | * | 9/1989 | Prusas et al. | 162/18 |
| 4,906,484 A | * | 3/1990 | Lambuth et al. | 428/326 |
| 4,997,488 A | * | 3/1991 | Gould et al. | 127/37 |
| 5,338,402 A | * | 8/1994 | Devic et al. | 162/24 |
| 5,348,620 A | * | 9/1994 | Hermans et al. | 162/9 |
| 5,656,129 A | * | 8/1997 | Good et al. | 162/13 |

FOREIGN PATENT DOCUMENTS

| | | |
|---|---|---|
| DE | 3609506 | 10/1986 |
| DE | 4211888 | 10/1993 |
| DE | 19515734 | 11/1996 |
| EP | 0292584 | 11/1988 |
| EP | 0373725 | 6/1990 |
| EP | 0664191 | 7/1995 |
| WO | 9112367 | 8/1991 |
| WO | 9325358 | 12/1993 |
| WO | 9524988 | 9/1995 |

OTHER PUBLICATIONS

Douglas J. Gardner and Thomas J. Elder: Bonding surface activated hardwood flakeboard with phenol–formaldehyde resin—Holzforschung 44 (3): 201–206, 1990 (English language).

J. M. McLaughlan and C.R. Anderson: In–Line fibre pretreatments for dry process medium density fibreboard: Initial Investigations—Paper presented at the Symposium Pacific Rim Bio–Based Composites, Rotorua, New Zealand Nov. 9–13, 1992, Symposium Proceedings, pp. 91–99, 1992 (English language).

Simon Ellis and Laszlo Pazner: Activated self–bonding of wood and agricultural residues—Holzforschung 48: 82–90, 1994 (English language).

Liu Zhengtian and Hao Bingye: Technology of rice–straw particleboard bonded by urea–formaldehyde resin modified by isocyanate—Paper presented at the Symposium Pacific Rim Bio–Based Composites, Rotorua, New Zealand Nov. 9–13, 1992 Symposium proceedings pp. 295–301, 1992 (English language).

* cited by examiner

*Primary Examiner*—Sam Chuan Yao
(74) *Attorney, Agent, or Firm*—Ladas & Parry

(57) ABSTRACT

A method for improving the bondability of annual plant materials to a formaldehyde-based resin including the steps of: (a) providing a straw plant material having a plurality of fibers with each of the fibers surrounded by a waxy and silica layer; (b) extruding the straw plant material in a twin screw extruder while simultaneously subjecting the straw plant material to a thermal treatment with an aqueous solution containing a lignin modifying agent or steam, the thermal treatment being conducted at a temperature between about 40° C. and 120° C., the extruding subjecting the straw plant material to a sufficiently high shear force such that the extruding with simultaneous thermal treatment achieves a substantial defibration of the straw plant material with destruction of the waxy and silica layer and formation of individual fibers and (c) subjecting the treated material to heat and pressure in the presence of the formaldehyde-based resin to form a resin-bonded fiberboard or particleboard.

11 Claims, No Drawings

METHOD FOR PRODUCTION OF LIGNOCELLULOSIC COMPOSITE MATERIALS

This application claims benefit of provisional application Ser. No. 60/015,283 filed Apr. 12, 1996.

FIELD OF INVENTION

This invention relates to the production of lignocellulosic fibres and formation of composite materials therefrom. It particularly relates to the production of such fibres and bonding with synthetic binders into composite materials.

BACKGROUND OF THE INVENTION

There is considerable pressure on the world's fibre resource. World-wide economic growth and development have created needs for converted forest products. While global fibre production systems are capable of meeting these overall demands there are some serious local and regional fibre shortages and resource management conflicts.

Many developing countries do not possess adequate forest reserves to cover their needs for fuelwood, industrial wood, sawn wood, and wood-based composition panels. However, many of these countries do have relatively large quantities of lignocellulosic materials available in the form of agricultural residues from annual crops. Annual plant fibres like cereal straw and the like are difficult to bond using conventional adhesives such as UF resins, PF-resins and PMDI binders.

The present invention is related, therefore, to a method of improving the bondability of lignocellulosic materials from annual plant fibres such as cereal straw by synthetic binders.

Composite materials such as particleboards, medium and high density fibreboards are mainly made from wood using binders such as acid curing amino-formaldehyde resins, alkaline curing phenol-formaldehyde resins, as well as polyisocyanate adhesives. Medium density fibreboards are fibreboards prepared using a dry technique as follows: Wood is subjected to thermomechanical pulping at a temperature of about 160 to 180° C., then mixed with the resin and dried. Thereafter mats are formed from the fibres and pressed to form fibreboards. Particleboards, on the other hand, can be prepared from chips which are mixed with resins and the glued particles are spread to mats and pressed at high temperature to particleboards.

Recently, interest has been developed on using agricultural residues like wheat and rice straw and sunflower as a starting material for particleboards and medium density fibreboards. The main difficulty in using annual plant residues such as straw as a raw material for composites, is their poor bondability particularly using urea-formaldehyde resins. The reason for this is probably the specific morphological structure of the straw, where the waxy and silica layer encirculating the straw stem inhibit sufficient direct contact between the binder and the straw fibres. Other types of adhesives for example polymeric isocyanates have been tried. However, the mechanical strength as well as the water resistance of the boards made from straw and isocyanates are much lower than those made from wood using the same bonding conditions.

Therefore, it was the main aim of the invention to find a practical method to improve the bondability of annual plant residues towards bonding agents in general and particularly towards acid curing aminoplastic resins and also polyisocyanate binders.

While fibrous/particulate ligno/cellulosic materials have been treated by water/steam treatments with simultaneous or subsequent high shear treatment, use of lower temperatures has only been in the context of treatments for the manufacture of paper or similar materials and there has been no suggestion that this treatment when applied to lignocellulosic materials in the context of producing composites would enhance the fibrous or particulate material for forming into composite material. The process of the invention is also to be distinguished from producing composite materials from lignocellulosic materials in which there is an initial treatment at high temperature of at least 150° C., usually 150° C. to 170° C. followed by defibration.

Thus many treatments have been described in the literature to improve the bondability of lignocellulosic materials in both particle and fibre form with synthetic resins. D. H. GARDNER and T. J. ELDER: (Bonding surface activated hardwood flakeboard with phenol-formaldehyde resin —Holzforschung 44(3): 201–206, 1990) added hydrogen peroxide, nitric acid or sodium hydroxide to enhance bonding characteristics of flakes using phenol-formaldehyde resins as a binder. Dimensional stability and internal bond strength were significantly reduced and it was shown that the chemicals did not change the wood surface, but rather they reacted with the resin.

J. McLAUGHLAN and C. R. ANDERSEN: (In-Line fibre pretreatments for dry process medium density fibreboard: Initial Investigations—Paper presented at the Symposium Pacific Rim Bio-Based Composites, Rotorua, New Zealand 9–13 Nov. 1992, Symposium Proceedings, page 91–99, 1992) tried many treatments to enhance the bondability of fibres towards bonding with urea-formaldehyde resins for the production of medium density fibreboards. The treatments include exposure to wet and dry heat, compression with heat and heat in combination with chemicals. The chemicals include 1% and 10% addition of aluminum sulphate, which is used in the hard board manufacture to control the pH value of the stock and 1% and 10% chromium trioxide. Almost all the treatments resulted in boards with reduced properties compared to the control.

SIMON AND L. PAZNER): (Activated self-bonding of wood and agricultural residues—Holzforschung 48: 82–90, 1994) investigated the influence of the hemicellulose content of the self-bonding behaviour of different raw materials including annual plants and concluded that there is a straightforward relation between the hemicellulose content in the raw materials and the bonding strength of composites prepared therefrom. According to this work hemicelluloses do have adhesive properties, however, bonds created using hemicellulose adhesives have almost no wet strength.

In a recent publication LIAN ZHENGTIAN and HAO BINGYE: (Technology of rice-straw particleboards bonded by Urea-formaldehyde resin modified by isocyanate—Paper presented at the Symposium Pacific Rim Bio-Based Composites, Rotorua, New Zealand 9–13 Nov. 1992 Symposium Proceedings, page 295–301, 1992) mentioned that slight improvement of bondability of straw can be achieved by destroying the waxy layers encircling the stem of straw, however, the bondability was still very poor and the boards made still could not meet the requirements of common standards.

In DE-A-36 09 506 is described a modified standard dry process for the production of MDF in which UF resin is injected after treatment of wood particles with overheated steam and separation of steam from the treated fibres. The treatment of the fibres is by a conventional disc refiner.

In US-A-3 843 431 composite panels are produced from fibres prepared using as starting material scraps, shavings, sawdust. The raw material is blended with water and ground with the use of a double-disc attrition mill.

In WO-A-93 25358 MDF is produced according to the standard dry process involving wood chips pre-treated prior to defibration. The pre-treatment procedure involves the impregnation of raw material with $Na_2SO_3/NaHSO_3$, and heating at a temperature between 150–200° C.

The aim of the present invention to develop a method for the treatment of annual plant fibres, so that their bondability to synthetic resins is significantly improved and the production of composite panels with properties that meet the requirements of common standards is effected.

SUMMARY OF THE INVENTION

It has been discovered that thermal treatment of straw or other annual plant fibres with water or steam at temperatures between 40–120° C., and preferably between 60 –100° C. accompanied by or followed by defibration of the fibres using high shear forces destroys the morphological structure of the straw and increases tremendously its affinity towards bonding.

According to the invention, therefore, there is provided a method for producing composite materials wherein a lignocellulosic material which is an annual plant fibre residue is subjected to treatment with water or steam at 40° to 120° C. and simultaneously or subsequently is subjected to a high shear treatment and thereafter is formed into a composite material. The invention also relates to a lignocellulosic material which is an annual plant fibre residue which has been subjected to such water/steam treatment and high shear treatment and is in a form suitable for bonding into a composite. The invention also relates to a composite material in which at least part of the fibre content is derived from said treated annual plant fibre residue.

DETAILED DESCRIPTION

Defibration in the sense of this invention means disruption of the morphological structure of straw leading to the creation of individual fibres. The treatment destroys the waxy and silica layer of straw, leading to higher accessibility of individual fibres to the binder.

Lignocellulosic annual plant fibre residues which can be used in this invention are to be distinguished from wood products or other plant products which do not grow on an annual basis. They include rice straw, rice husks, wheat straw, rye straw, cotton stalks, miscanthus, sorghum and sunflower.

Binders or bonding agents are those conventionally employed in forming composite products and include both acidic and alkaline type binders. Typical bonding agents are amino resins, phenolic resins, resorcinol resins, tannin resins, isocyanate adhesives or mixtures thereof. Thus resins which can be used to bond treated straw fibres include urea-formaldehyde resins (UF-resins), melamine-urea-formaldehyde resins (MUF-resins), melamine resins (MF-resins), phenol-formaldehyde resins (PF-resins), resorcinol-formaldehyde resins (RF-resins), tannin-formaldehyde resins (TF-resins), polymeric isocyanate binders (PMDI) and mixtures thereof. The resins can be added in the amount of 5–15% based on dry straw materials employed in the final composite.

The hydro-thermal treatment can be with water alone or with water and treating agents as will be later described.

High shear treatment is an application to the fibre of interaction between mechanical surfaces which imposes a high shear force on the fibre as distinct from prior art low shear grinding or similar attrition treatments. Those skilled in the art are well aware of high shear devices which are exemplified by twin screw extruders, disc refiners, ultra turrax or any other suitable high shear mill. The rate of extrusion depends upon the conditions used and also the type of machine applied and can differ from 5 kg/h to 20 t/h.

The intensity of shearing applied must be such that, depending upon the type of composite which is to be prepared from the straw, one achieves a substantial defibration of the straw. For MDF and high density fibreboard, it is necessary to reach more or less complete defibration of the straw, so as to produce treated straw that displays sufficient bonding affinity towards a UF resin, to enable formation of boards having certain desired properties. Medium density fibreboards cover a wide range of densities between 0.6 and 0.8 g/cm$^3$ depending on their thickness and field of application. Boards with density lower than 0.5b g/cm$^3$ are not common, but can be produced. The quality required depends on the field of application of the board and its thickness:

| | For >6–12 mm thickness | For >12–19 mm thickness |
|---|---|---|
| Internal Bond (IB), N/mm$^2$ | 0.65 | 0.60 |
| Bending strength (MOR), N/mm$^2$ | 35 | 30 |

For particleboards on the other hand, partial difibration would be sufficient. Particleboards are prepared in the density range of 0.4 to 0.85 g/cm$^3$ depending upon their field of application and thickness. Boards with density lower than 0.5 g/cm$^3$ are low-density boards, between 0.5 and 0.7 g/cm$^3$ are medium density and greater than 0.7 g/cm$^3$ are high density boards. Also, in the case of particleboards, the requirements depend on the field of application and thickness of the boards.

| | For >6–12 mm thickness | For >12–19 mm thickness |
|---|---|---|
| Internal Bond (IB), N/mm$^2$ | 0.40 | 0.35 |
| Bending strength (MOR), N/mm$^2$ | 17 | 15 |

The properties of the boards made from straw can be further improved if the straw is treated with various chemicals which are fibrous property lignocellulose modification agents. These reagents can be used either alone or in combination and include metal hydroxides, such as lithium, sodium, potassium, magnesium and aluminium hydroxide, organic and inorganic acids, such as phosphoric, hydrochloric, sulphuric, formic and acetic acid, salts, such as sodium sulphate, sodium sulphite and sodium tetraborate, oxides, such as aluminum oxide; various amines and urea, ammonia, as well as ammonium salts. These reagents can be used in the form of water solution or suspension in quantities of from 0.01 to 10% based on dry material.

The chemical treatment and the defibration are carried out in one step, by subjecting the straw to a stream of water during the high shear stage, containing the amount of chemical needed to upgrade the properties of the amino resin bonded boards. After the defibration, the fibres produced can be dried using conventional dryers used in particleboard factories, e.g. a drum dryer or a tube dryer, like that used in medium density fibreboard mills. From then onwards, the dried fibres follow the conventional procedures as for the production of particleboard or medium density fibreboard.

It is also one of the embodiments of this invention to mix the annual plant fibres with a binder or a binder mixture already in the high shear machine. UF, MUF, MF, PF, RF and TF resins can be employed for this purpose. In the case of amino resins, the adhesive can be added in a pre-catalysed or latently catalysed or non-catalysed state. A catalyst can also be added separately in the high shearing stage. Mixtures of resins like UF-polyisocyanates can also be used in the same way.

The addition of a sizing agent is not obligatory. However, it can be added, if appropriate, either in the high shear machine or separately. Other components of a standard glue mixture like formaldehyde scavengers and extenders can also be added in the same way.

The final composite materials can be panel products, reconstituted lumber products and moulded articles including particleboard, waferboard and fibreboard.

The resulting composition boards produced from treated straw fibres are very different from the boards produced using standard chopped straw. The appearance, surface smoothness and core density profile are superior, approaching the quality of medium density fibreboards. Excellent edge properties and improved board machineability are further advantages of the process. High density boards can be produced, without the need to apply high board forming pressures.

In a further embodiment of the invention, treated straw fibres can be used as a partial substitute for wood chips in the production of wood particleboards. The benefit is an improvement of board general appearance, density profile and machineability. Wood substitution levels of between 1–50%, and preferably between 10–30% can be employed. The conventional procedure for the production of particleboards is applied.

The following examples demonstrate the invention, without limiting its scope of application.

PRODUCTION OF REFERENCE BOARDS

Reference boards were produced in the laboratory by conventional techniques using untreated chopped wheat straw. The target board thickness was both 16 and 8 mm and three types of binders were employed: UF resin, PF resin and PMDI. The first two resins were used at a level of 10% in their catalysed form, while PMDI at a level of 3% on a dry basis. The pressing temperature was 180° C. and the press pressure was 35 Kg/cm$^2$. Three replicate boards were produced in each case and their properties were subsequently determined. The average values of board properties are presented below.

| | 8 mm | | | 16 mm | | |
|---|---|---|---|---|---|---|
| | PMDI | PF | UF | PMDI | PF | UF |
| IB, N/mm$^2$ | 0.45 | 0.25 | 0.04 | 0.39 | 0.20 | 0.03 |
| MOR, N/mm$^2$ | 17.6 | 12.1 | 3.2 | 15.1 | 10.9 | 3.0 |
| HCHO, mg/100 g | 1.2 | 1.0 | 3.5 | 1.4 | 1.1 | 3.8 |
| Swell 24 h, % | 54.2 | 63.2 | 79.0 | 48.0 | 56.0 | 83.0 |
| Density, Kg/m$^3$ | 710 | 695 | 680 | 601 | 600 | 550 |

The formaldehyde (HCHO) emission was determined using the perforator method.

From these tests it can be seen that it is difficult to meet the requirements of common standards even when PMDI binder is used. The resultant board density values exemplified were almost the highest that could be achieved by these techniques.

EXAMPLE 1

Wheat straw was treated in a twin screw extruder device with water at 55° C. and steam at 100° C. The straw fibres were produced at a rate of 10 kg/h. In order to produce boards, the resultant fibres were mixed with both UF resin and PMDI binder. The target board thickness was 16 mm and the rest of the production conditions were the same as above. The average values of board properties are presented below.

| | 55° C. | | 100° C. | |
|---|---|---|---|---|
| | PMDI | UP | PMDI | UF |
| IB, N/mm$^2$ | 0.55 | 0.27 | 0.60 | 0.32 |
| HCHO, mg/100 g | 0.3 | 8.2 | 0.4 | 6.2 |
| Swell 24 h, % | 30.0 | 39.7 | 27.1 | 39.4 |
| Density, Kg/m$^3$ | 680 | 715 | 684 | 720 |

The above results reveal that bonding was strongly enhanced by treating the straw according to the present invention. As the results show, treating the straw at 55° C. has led to a significant improvement in the bonding strength and thickness swelling. Further increase in the temperature during the extrusion stage upgraded the properties of the boards less significantly.

EXAMPLE 2

Wheat straw was treated in a twin screw extruder device at 60° C. by injecting water solutions of 1.3% NaOH, 0.5% urea and combination of 0.5% NaOH and 0.5% $H_2SO_4$. The fibres produced were used for the production of 16 mm lab scale boards after mixing with UF resin. The rest production conditions were the same as above. For comparison purposes, fibres produced in the extruder by using only water were also tested. The average values of board properties are presented below.

| | $H_2O$ | NaOH | Urea | NaOH—$H_2SO_4$ |
|---|---|---|---|---|
| IB, N/mm$^2$ | 0.30 | 0.34 | 0.31 | 0.38 |
| HCHO, mg/100 g | 5.3 | 7.1 | 6.4 | 5.4 |
| Swell 24 h, % | 40.5 | 43.0 | 38.9 | 46.3 |
| Density, Kg/m$^3$ | 686 | 684 | 683 | 678 |

By treating the straw with various chemicals during the extrusion, a further improvement of the mechanical strength of the resultant boards was achieved.

EXAMPLE 3

Wheat straw was treated in a twin screw extruder device at 60° C. by injecting water solutions of 0.2% NaOH and 1.0% $Na_2SO_3$. The fibres produced were used for the production of 8 mm lab scale boards after mixing with UF resin and/or PMDI. For comparison purposes, fibres produced in the extruder using only water were also tested. The rest of the production conditions were the same as above. The average values of board properties are presented below.

| | $H_2O$ | | NaOH | | $Na_2SO_3$ |
|---|---|---|---|---|---|
| | PMDI | UF | PMDI | UF | UF |
| IB, N/mm$^2$ | 0.74 | 0.65 | 0.83 | 0.58 | 0.41 |
| MOR, N/mm$^2$ | 13.1 | 17.7 | 18.9 | 14.5 | 11.8 |
| HCHO, mg/100 g | 0.5 | 7.5 | 0.3 | 9.0 | 8.3 |
| Swell 24 h, % | 21.8 | 45.2 | 23.4 | 46.0 | 46.1 |
| Density, Kg/m$^3$ | 650 | 800 | 750 | 800 | 750 |

EXAMPLE 4

A similar test was carried out by treating the wheat straw in the extruder with a combination of 0.5% $Na_2SO_3$ and 0.1% $H_2SO_4$. In this case, three resin types were used for the production of 8 mm boards: UF, MUF and PF resin. Results were presented in the following table.

| | UF | MUF | PF |
|---|---|---|---|
| IB, N/mm$^2$ | 0.34 | 0.43 | 0.68 |
| MOR, N/mm$^2$ | 17.6 | 20.1 | 35.6 |
| HCHO, mg/100 g | 7.6 | 3.7 | 2.2 |
| Swell 24 h, % | 46.3 | 37.2 | 24.8 |
| Density, Kg/m$^3$ | 790 | 795 | 792 |

Boards with properties that meet the requirements of common standards can be produced from treated straw fibres according to the present invention, when high performance resins are applied.

EXAMPLE 5

Another test was carried out using as starting materials rice and flax residues. The materials had been treated in a twin screw extruder device with 0.3% NaOH at 100° C. 8 mm boards were produced in the lab from the extruded fibres and PMDI or UF resins. Results from the testing of board properties are presented in the following table.

| | Rice | | Flax |
|---|---|---|---|
| | PMDI | UF | PMDI |
| IB, N/mm$^2$ | 0.52 | 0.34 | 0.90 |
| MOR, N/mm$^2$ | 15.3 | 13.1 | 12.7 |
| HCHO, mg/100 g | 1.5 | 9.4 | 1.3 |
| Swell 24 h, % | 20.1 | 33.7 | 22.5 |
| Density, Kg/m$^3$ | 800 | 700 | 700 |

From the above results it can be concluded that the process can be applied to a wide variety of plant residues or agricultural fibres.

EXAMPLE 6

Wheat straw was treated in an ultra turrax device at 70° C., by employing an aqueous NaOH solution of 2%. The fibres produced were used for the production of 8 mm lab scale boards after mixing with UF resin. The other production conditions were as above. For comparison purposes, fibres produced in the extruder by using 1.3% NaOH were also tested. The average values of board properties are presented below.

| | Extruder treated straw | Ultra turrax treated straw |
|---|---|---|
| IB, N/mm$^2$ | 0.38 | 0.29 |
| MOR, N/mm$^2$ | 18.3 | 16.1 |
| HCHO, mg/100 g | 6.8 | 5.4 |
| Swell 24 h, % | 30.4 | 60.5 |
| Density, Kg/m$^3$ | 745 | 754 |

From the above-mentioned figures one can see that boards produced by both methods are equivalent. Even though mechanical and swelling values are somewhat worse, when the ultra turrax is used, the free formaldehyde values are improved.

EXAMPLE 7

Particleboards were produced by partially substituting wood chips with a quantity of wheat straw fibres, produced in a twin screw extruder device with 0.5% $Na_2SO_3$ and 0.1% $H_2SO_4$ at 100° C. Two resin types were used for the board production: MUF and UF resin. The substitution levels of fibre for wood employed for each type of glue were:

MUF—10 and 20%

UF—10 and 15%

The assessment of board properties provided the results shown below.

| Resin | Wood Substitution | Density Kg/m$^3$ | MOR N/mm$^2$ | IB N/mm$^2$ | Swell 2 h % |
|---|---|---|---|---|---|
| MUF | 0% | 666 | 19.3 | 0.67 | 2.5 |
| MUF | 10% | 657 | 17.0 | 0.69 | 2.8 |
| MUF | 20% | 642 | 16.7 | 0.60 | 3.6 |
| UF | 0% | 633 | 14.1 | 0.49 | 5.1 |
| UF | 10% | 633 | 15.3 | 0.47 | 5.1 |
| UF | 15% | 622 | 14.1 | 0.46 | 5.6 |

The above results indicate that particleboards can be effectively produced by substituting part of the wood chips with extruded straw fibres. Advantages are an improvement of the general appearance of the board and of corresponding board properties.

What is claimed is:

1. A method for improving the bondability of annual plant materials to a formaldehyde-based resin selected from the group consisting of urea-formaldehyde resin (UF resin), melamine-urea formaldehyde resin (MUF resin), melamine-formaldehyde resin (MF resin), phenol-formaldehyde resin (PF resin), resorcinol-formaldehyde resin (RF resin) tannin-formaldehyde resin (TF resin) and mixtures thereof, said method comprising the steps of:

(a) providing a straw plant material having a plurality of fibers with each of the fibers surrounded by a waxy and silica layer;

(b) extruding the straw plant material in a twin screw extruder while simultaneously subjecting the straw plant material to a thermal treatment with an aqueous solution containing a lignin modifying agent or steam, said thermal treatment being conducted at a temperature between about 40° C. and 120° C., said extruding subjecting the straw plant material to a sufficiently high shear force such that the extruding with simultaneous thermal treatment achieves a substantial defibration of the straw plant material with destruction of the waxy and silica layer and formation of individual fibers and such that the treated straw plant material has an enhanced affinity for the resin as compared with an affinity for the resin of the annual plant material provided in step (a), whereby to enable formation from the treated material of a fiberboard or particleboard that has greater internal bond strength, reduced thickness swelling and higher density than a fiberboard or particleboard formed from the straw plant material provided in step (a); and (c) subjecting the treated material to heat and pressure in the presence of the formaldehyde-based resin to form a resin-bonded fiberboard or particleboard that has greater internal bond strength, reduced thickness swelling and higher density than a fiberboard or particleboard that is formable from the straw plant material provided in step (a) that is subjected to said heat and pressure.

2. A method according to claim 1, wherein the straw plant material is selected from the group consisting of wheat straw, barley straw and rice straw.

3. A method according to claim 1, wherein the lignin modifying agent is selected from the group consisting of a metal hydroxide, an organic acid, an inorganic acid, a salt, an oxide and mixtures thereof.

4. A method according to claim 1, wherein the formaldehyde-based resin is selected from the group consisting of urea-formaldehyde resin (UF-resin) or phenol-formaldehyde resin (PF-resin).

5. A method according to claim 1, wherein the treated straw material subjected to heat and pressure in step (c) is combined with wood particles.

6. A method for improving the bondability of annual plant materials to a formaldehyde-based resin selected from the group consisting of, said method comprising the steps of:

(a) providing a straw plant material having a plurality of fibers with each of the fibers surrounded by a waxy and silica layer;

(b) extruding the straw plant material in a twin screw extruder while simultaneously subjecting the straw plant material to a thermal treatment with an aqueous solution containing a lignin modifying agent selected from the group consisting of a metal hydroxide, an organic acid, an inorganic acid, a salt, an oxide and mixtures thereof, said thermal treatment being conducted at a temperature between about 40° C. and 120° C., said extruding subjecting the straw plant material to a sufficiently high shear force such that the extruding with simultaneous thermal treatment achieves a substantial defibration of the straw plant material with destruction of the waxy and silica layer and formation of individual fibers and such that the treated straw plant material has an enhanced affinity for the resin as compared with an affinity for the resin of the annual plant material provided in step (a), whereby to enable formation from the treated material of a fiberboard or particleboard that has greater internal bond strength, reduced thickness swelling and higher density than a fiberboard or particleboard formed from the straw plant material provided in step (a), and (c) subjecting the treated material to heat and pressure in the presence of the formaldehyde-based resin to form a resin-bonded fiberboard or particleboard that has greater internal bond strength, reduced thickness swelling and higher density than a fiberboard or particleboard that is formable from the straw plant material provided in step (a) that is subjected to said heat and pressure.

7. A method according to claim 6, wherein the straw plant material is selected from the group consisting of wheat straw and rice straw.

8. A method according to claim 6, wherein the formaldehyde-based resin is selected from the group consisting of urea-formaldehyde resin (UF-resin), melamine-urea formaldehyde resin (MUF resin), melamine-formaldehyde resin (MF resin), phenol-formaldehyde resin (PF-resin), resorcinol-formaldehyde resin (RF resin), tannin-formaldehyde resin (TF resin) and mixtures thereof.

9. A method according to claim 6, wherein the treated straw material subjected to heat and pressure in step (c) is combined with wood particles.

10. A method according to claim 1, wherein the extruding is carried out at an extrusion rate of from 5 kg/h to 20 t/h.

11. A method according to claim 6, wherein the extruding is carried out at an extrusion rate of from 5 kg/h to 20 t/h.

* * * * *